US007616178B2

(12) United States Patent
You et al.

(10) Patent No.: US 7,616,178 B2
(45) Date of Patent: Nov. 10, 2009

(54) DRIVING DEVICE AND DRIVING METHOD FOR A LIGHT EMITTING DEVICE, AND A DISPLAY PANEL AND DISPLAY DEVICE HAVING THE DRIVING DEVICE

(75) Inventors: Bong-Hyun You, Yongin-si (KR); Min-Koo Han, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 782 days.

(21) Appl. No.: 11/129,603

(22) Filed: May 14, 2005

(65) Prior Publication Data

US 2005/0259703 A1 Nov. 24, 2005

(30) Foreign Application Priority Data

May 19, 2004 (KR) ..... 10-2004-0035656

(51) Int. Cl.
*G09G 3/30* (2006.01)

(52) U.S. Cl. ..... 345/79; 345/76; 345/77; 345/78; 345/207; 345/209; 345/690

(58) Field of Classification Search ..... 345/76–83, 345/207, 209, 690; 315/169.3
See application file for complete search history.

(56) References Cited

U.S. PATENT DOCUMENTS

| | | | | |
|---|---|---|---|---|
| 5,708,452 | A * | 1/1998 | Takahashi | 345/82 |
| 6,229,508 | B1 * | 5/2001 | Kane | 345/82 |
| 6,677,713 | B1 * | 1/2004 | Sung | 315/169.1 |
| 7,230,591 | B2 * | 6/2007 | Inukai | 345/76 |
| 7,365,719 | B2 * | 4/2008 | Miyagawa | 345/82 |
| 2002/0176030 | A1 * | 11/2002 | Matsumoto | 349/43 |

* cited by examiner

*Primary Examiner*—Henry N Tran
*Assistant Examiner*—Viet Pham
(74) *Attorney, Agent, or Firm*—F. Chau & Associates, LLC

(57) ABSTRACT

A driving device and driving method for a light emitting device, and a display panel and display having the driving device are provided. In a display device having a light emitting diode, first and second driving parts are connected to the light emitting diode. A first switching part applies a first data voltage having a first direction and a second data voltage having a second direction opposite the first direction to the first and second driving parts, respectively, during a first frame. A second switching part applies the second data voltage and the first data voltage to the first and second driving parts, respectively, during a second frame.

23 Claims, 8 Drawing Sheets

DRIVING DEVICE AND DRIVING METHOD FOR A LIGHT EMITTING DEVICE, AND A DISPLAY PANEL AND DISPLAY DEVICE HAVING THE DRIVING DEVICE

CROSS-REFERENCE TO RELATED APPLICATION

This application claims priority to Korean Patent Application No. 2004-35656 filed on May 19, 2004, the contents of which are incorporated herein by reference in its entirety.

1. Technical Field

The present invention relates to a driving device for a light emitting device, and a display panel and display device having the driving device, and more particularly, to a driving device and driving method for a light emitting device capable of stably maintaining transistor characteristics.

2. Description of the Related Art

Recently, display devices having various characteristics such as small sizes, light weights, low manufacturing costs and high lighting efficiencies have been developed. Light emitting devices that generate light using, for example, a polymer material, which do not have a backlight assembly as a light source, are increasingly being used as display devices. Such light emitting devices, generally, are thinner, have lower manufacturing costs and wider visual angles in comparison with a liquid crystal display device.

The light emitting device is classified as either an active matrix type light emitting device or a passive matrix type light emitting device according to a switching device used therein.

FIG. 1 is a circuit diagram showing a pixel of a conventional light emitting device. FIG. 2 is a waveform diagram of a data signal applied to the pixel shown in FIG. 1.

Referring to FIGS. 1 and 2, a pixel of a conventional light emitting device includes a switching transistor QS for switching a data signal in response to a scan signal, a storage capacitor CST for storing the data signal for a frame, a driving transistor QD for generating a bias voltage in response to the data signal, and a light emitting diode EL having a first terminal for receiving a common voltage VCOM and a second terminal for receiving a bias voltage. The light emitting diode EL emits light in response to a current corresponding to the bias voltage.

The light emitting device uses an active driving method and has an increased light emitting duty, which is different from a passive driving method, because the light emitting device has a lower brightness than, for example, a cathode ray tube display device. An activation layer of the light emitting diode EL emits light corresponding to an injected current density.

Generally, the light emitting device includes a polysilicon transistor having a manufacturing cost that is higher than an amorphous silicon transistor. This is due to a lower mobility of the amorphous silicon as compared to the polysilicon. The amorphous silicon is difficult, however, to form in a positive (P)-type transistor and has an unstable bias stress as compared to the polysilicon.

When the light emitting device includes the amorphous silicon transistor, the light emitting device is constituted by only negative (N)-type transistors as driving circuits. However, in a light emitting device employing a current driving type transistor, a current flowing through the light emitting diode EL has to be adjusted to embody a gray-scale.

As shown in FIG. 1, to adjust the current flowing through the light emitting diode EL based on the data signal externally provided, the light emitting diode EL is connected to the driving transistor QD in series and the data signal is applied to a gate electrode (e.g., a control electrode) of the driving transistor QD, thereby adjusting a channel conductance according to a gate-source voltage Vgs of the driving transistor QD. When the driving transistor QD is the (P)-type transistor, a level of the gate-source voltage Vgs of the driving transistor QD is decided by the data signal (e.g., a data voltage) inputted to the gate electrode of the driving transistor QD through a data line DL.

However, when the driving transistor is the N-type transistor, a voltage at a node where the driving transistor QD is connected to the light emitting diode EL is not uniform because the light emitting diode EL is operated as a source. Thus, the node voltage depending upon data of a previous frame or a range of the gate-source voltage of the driving transistor QD is reduced in comparison with an active region of the data voltage. The light emitting device may employ the P-type transistor as the driving transistor QD.

The output characteristics of the amorphous silicon transistor deteriorate while the data voltage is applied in a certain way to the gate electrode of the amorphous silicon transistor. In other words, when the data voltage is applied to the gate electrode of the amorphous silicon transistor, which is used as the driving transistor QD for controlling the output current in accordance with the gate voltage for a long time, the output characteristics of the amorphous silicon transistor are deteriorated. Thus, the driving transistor QD malfunctions due to the deterioration of its output characteristics resulting in a shortened life span of the amorphous silicon, and therefore, an amorphous silicon transistor is not typically used as the driving transistor QD.

When the gate voltage is applied to the gate electrode of the amorphous silicon transistor, the light emitting diode EL is controlled by the output current from the amorphous silicon transistor. The amorphous silicon transistor is designed such that the level of the gate voltage is varied while the source and drain voltages are constant. Thus, a threshold voltage and the output current are varied due to a charge injection between a gate insulator and the gate electrode, a trapping and defects of the amorphous silicon layer.

As a result, because the charge injection and defects increase after an operation time, the output characteristics of the amorphous silicon transistor deteriorate further.

SUMMARY OF THE INVENTION

The present invention provides a driving device for a light emitting device, capable of stably maintaining transistor characteristics. The present invention also provides a method for driving the driving device, a display panel having the driving is device and a display device having the display panel.

In one aspect of the present invention, a driving device for controlling a current applied to a light emitting diode includes a first driving part, a second driving part, a first switching part and a second switching part.

The first and second driving parts are connected to the light emitting diode. The first switching part is activated for a first frame to apply a first data voltage and a second data voltage to the first driving part and the second driving part, respectively. The first data voltage has a first direction and the second data voltage has a second direction opposite the first direction. The second switching part is activated for a second frame to apply the second data voltage and the first data voltage to the first driving part and the second driving part, respectively.

In another aspect of the present invention, to drive a light emitting diode having a first transistor comprising a first current electrode connected to a bias voltage and a second current electrode connected to the light emitting diode, and a second transistor comprising a third current electrode connected to the bias voltage and a fourth current electrode connected to the light emitting diode, a first scan signal at a high level during a first frame is applied to the light emitting diode. In response to the first scan signal, a first data voltage of a first direction and a second data voltage of a second direction are applied to a control electrode of the first transistor and a control electrode of the second transistor, respectively, of the light emitting diode. A second scan signal at a high level during a second frame is applied to the light emitting diode. In response to the second scan signal, the second data voltage of the second direction and the first data voltage of the first direction are applied to the control electrode of the first transistor and the control electrode of the second transistor, respectively, of the light emitting diode.

In another aspect of the present invention, a display panel includes a first data line, a second data line, a bias line, a first scan line, a second scan line, a light emitting diode and a driving part.

The first data line transmits a first data signal of a first direction, the second data line transmits a second data signal of a second direction, and the bias line transmits a bias voltage. The first scan line transmits a first scan signal, the second scan line transmits a second scan signal, and a light emitting diode is formed in a region defined by two adjacent data lines and two adjacent scan lines.

The driving part is formed in the region. The driving part controls a driving current applied to the light emitting diode in response to the first data signal when the first scan line is activated, and controls the driving current applied to the light emitting diode in response to the first data signal when the second scan line is activated.

In another aspect of the present invention, a display device includes a timing controller, a data driver, a scan driver and a light emitting display panel.

The timing controller outputs an image signal and a timing signal. The data driver outputs a first data signal of a first direction and a second data signal of a second direction in response to the image signal. The scan driver alternately outputs a first scan signal and a second scan signal at every two frames in response to the timing signal.

The light emitting display panel includes a light emitting diode, a first transistor connected to the light emitting diode, and a second transistor connected to the light emitting diode.

The light emitting display panel displays an image in response to the first data signal applied to the first transistor when the first scan signal is applied to the first transistor and prevents deterioration of the second transistor in response to the second data signal applied to the second transistor. Also, the light emitting display panel displays the image in response to the first data signal applied to the second transistor when the first scan signal is applied to the second transistor and prevents deterioration of the first transistor in response to the second data signal applied to the first transistor.

BRIEF DESCRIPTION OF THE DRAWINGS

The above and other features of the present invention will become more apparent by describing in detailed exemplary embodiments thereof with reference to the accompanying drawings, in which.

DETAILED DESCRIPTION OF EXEMPLARY EMBODIMENTS

Figure 1:
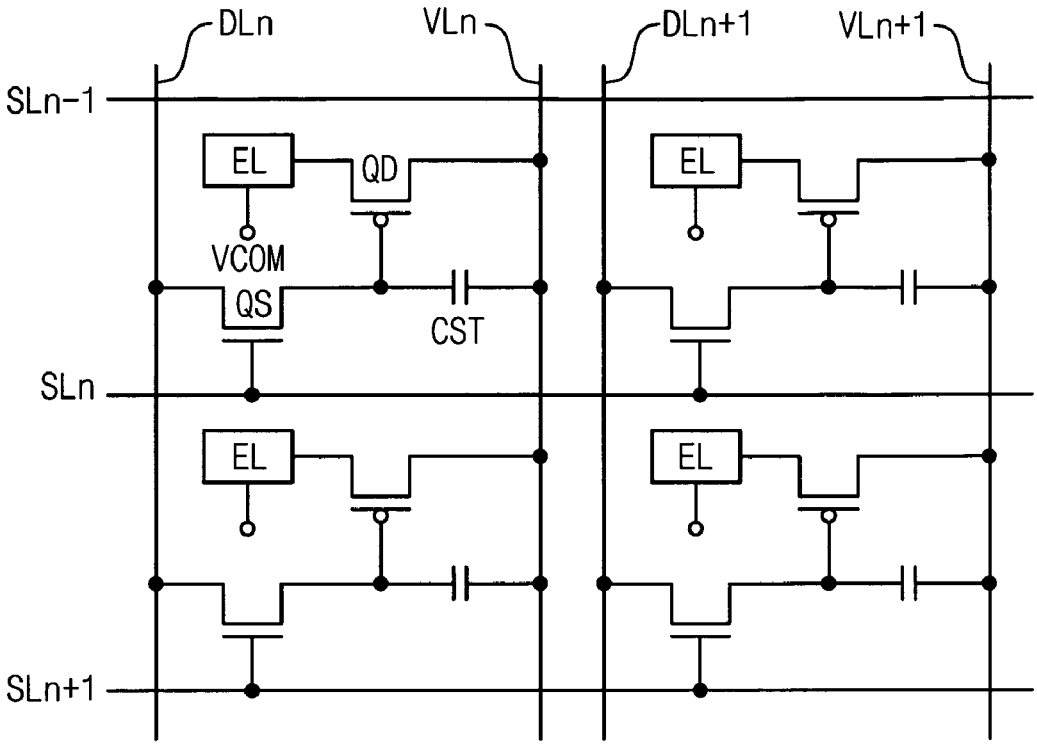
FIG. 1 (PRIOR ART)
FIG. 1 is a circuit diagram showing a pixel of a conventional light emitting device.
Figure 2:
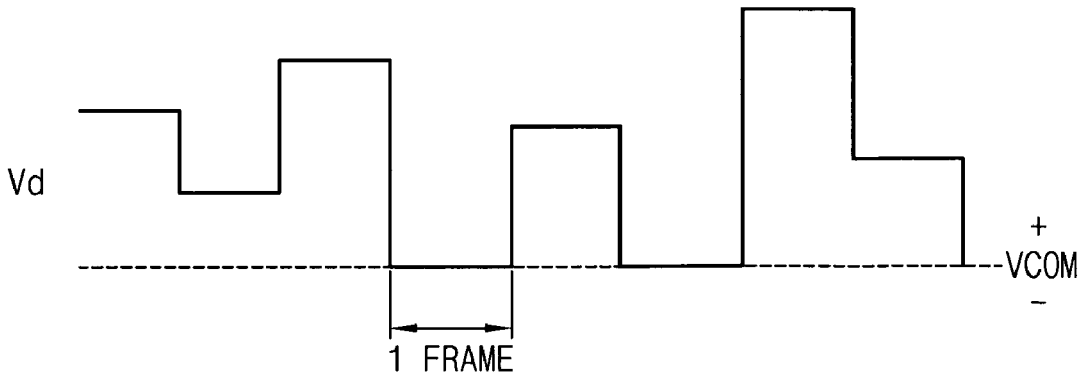
FIG. 2 (PRIOR ART)
FIG. 2 is a waveform diagram of a data signal applied to the pixel shown in FIG. 1.
Figure 3:
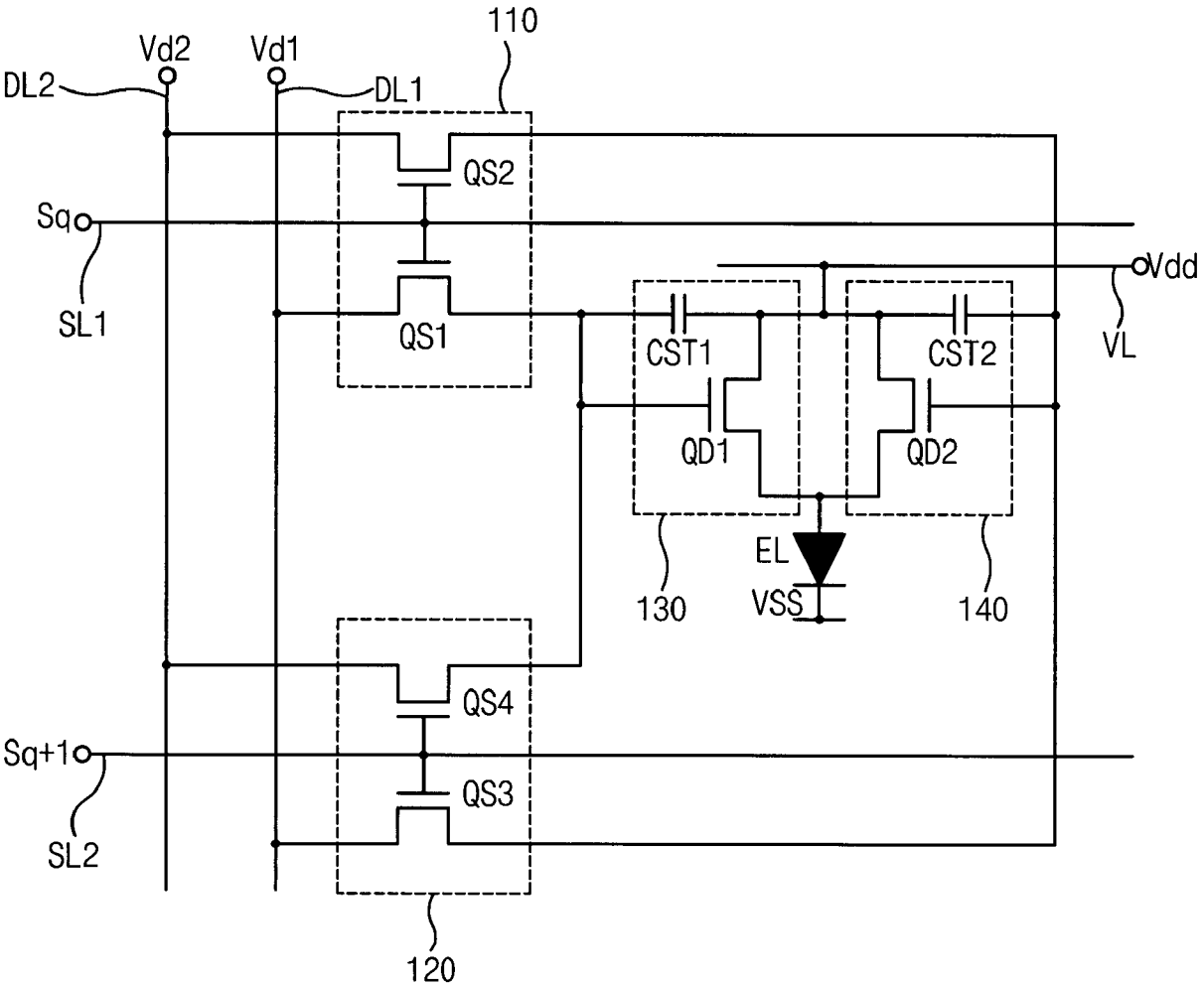
FIG. 3 is a circuit diagram showing a light emitting device according to an exemplary embodiment of the present invention.
Figure 4A:
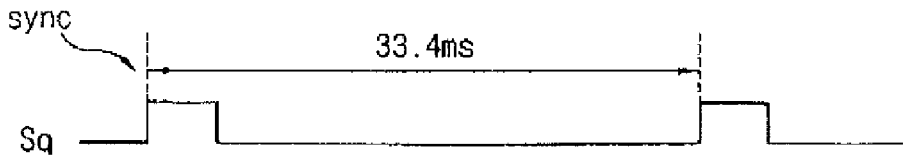
FIGS. 4A to 4D are waveform diagrams of signals applied to the light emitting device shown in FIG. 3.
Figure 4B:
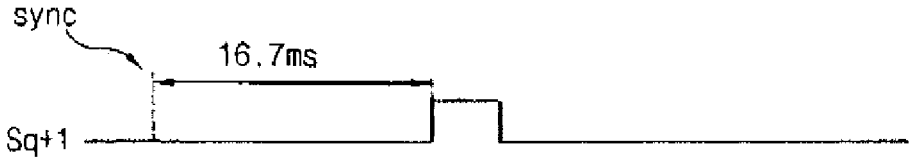
Figure 4C:
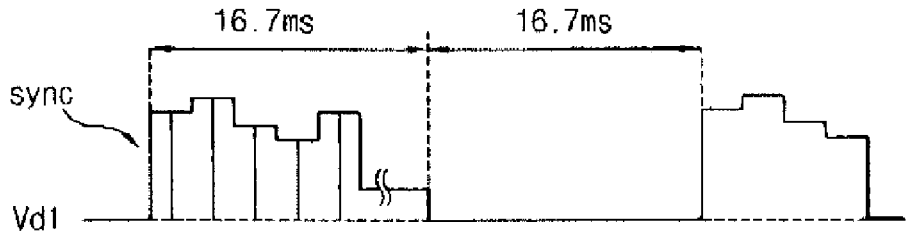
Figure 4D:
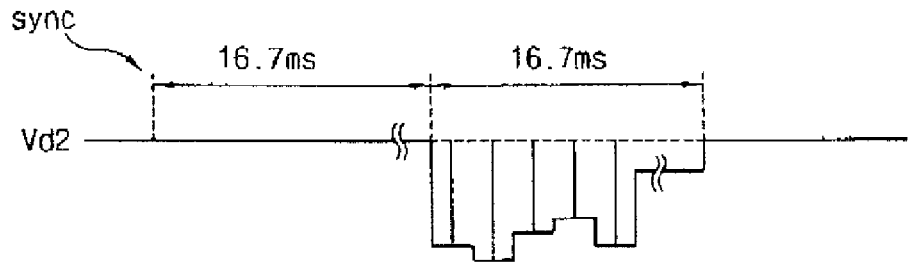

FIG. 3 is a circuit diagram showing a light emitting device according to an exemplary embodiment of the present invention. FIGS. 4A to 4D are waveform diagrams of signals applied to the light emitting device shown in FIG. 3.

Referring to FIG. 3, the light emitting device includes a plurality of pixels formed in a matrix configuration. Each of the pixels includes a first data line DL1, a second data line DL2, a bias line VL, a first scan line SL1, a second scan line SL2, a first switching part 110, a second switching part 120, a first driving part 130, a second driving part 140 and a light emitting diode EL.

The first data line DL1 is extended in a vertical direction to transmit a first data signal Vd1 externally provided to the first and second switching parts 110 and 120. The second data line DL2 is also extended in the vertical direction to transmit a second data signal Vd2 externally provided to the first and second switching parts 110 and 120.

The first data signal Vd1 has a polarity opposite a polarity of the second data signal Vd2. In the present embodiment, the first data signal Vd1 has a same level as the second data signal Vd2.

The bias line VL receives a bias voltage Vdd and transmits the bias voltage Vdd to the first and second driving parts 130 and 140. The bias line VL may be formed in the vertical direction parallel to the first and second data lines DL1 and DL2 or in a is horizontal direction parallel to the first and second scan lines SL1 and SL2.

The first scan line SL1 is extended in the horizontal direction to transmit a first scan signal Sq to the first switching part 110. The second scan line SL2 is also extended in the horizontal direction to transmit a second scan signal Sq+1 to the second switching part 120. The first and second scan signals Sq and Sq+1 are alternately applied at every two frames. In other words, when the first scan signal Sq is activated for a first frame, the second scan signal Sq+1 is inactivated for the first frame. On the contrary, when the second scan signal Sq+1 is activated for a second frame, the first scan signal Sq is inactivated for the second frame.

The first switching part 110 includes a first switching transistor QS1 and a second switching transistor QS2. The first switching transistor QS1 has a gate electrically connected to a gate of the second switching transistor QS2. The first switching part 110 receives the first scan signal Sq at a high level for a first frame, and applies the first and second data signals Vd1 and Vd2 to the first and second driving parts 130 and 140, respectively.

In response to the first scan signal Sq at the high level applied to the gate thereof, the first switching transistor QS1 outputs the first data signal Vd1 to the first driving part 130 through a source thereof, which is inputted through the first data line DL1 connected to a drain thereof, to thereby apply a driving current to the light emitting diode EL. In response to the first scan signal Sq at the high level applied to the gate thereof, the second switching transistor QS2 outputs the second data signal Vd2 to the second driving part 140 through a source thereof, which is inputted through the second data line DL2 connected to a drain thereof, to thereby recover the second driving part 140.

The second switching part 120 includes a third switching transistor QS3 and a fourth switching transistor QS4. The third switching transistor QS3 has a gate electrically connected to a gate of the fourth switching transistor QS4. The second switching part 120 receives the second scan signal Sq+1 at a high level for a second frame, and applies the second and first data signals Vd2 and Vd1 to the first and second driving parts 130 and 140, respectively.

In response to the second scan signal Sq+1 at the high level applied to the gate thereof, the third switching transistor QS3 outputs the first data signal Vd1 to the second driving part 140 through a source thereof, which is inputted through the first data line DL1 connected to a drain thereof, to thereby apply the driving current to the light emitting diode EL. In response to the second scan signal Sq+1 at the high level applied to the gate, the fourth switching transistor QS4 outputs the second data signal Vd2 to the first driving part 130 through a source thereof, which is inputted through the second data line DL2 connected to a drain thereof, to thereby recover the first driving part 130.

The first driving part 130 includes a first storage capacitor CST1 and a first driving transistor QD1. The first driving part 130 is connected to an anode of the light emitting diode EL to control a current flowing through the light emitting diode EL.

Particularly, the first storage capacitor CST1 has a first terminal connected to the source of the first switching transistor QS1 and the gate of the first driving transistor QD1 and a second terminal connected to the bias line VL. The first storage capacitor CST1 continuously applies a charged electron therein to the first driving transistor QD1 for one frame while the first data signal Vd1 is not applied due to the turning-off of the first switching transistor QS1.

The first driving transistor QD1 controls the level of the bias voltage Vdd applied to the drain thereof to supply the current to drive the light emitting diode EL in response to the first data signal Vd1 applied to the gate thereof. The value of the current applied to the light emitting diode EL from the first driving transistor QD1 depends upon the level of the first data signal Vd1 applied to the gate of the first driving transistor QD1, thereby adjusting a lighting level of the light emitting diode EL.

When the second data signal Vd2 is applied to the gate of the first driving transistor QD1, the first driving transistor QD1 is turned off, thereby dispersing electric charges concentrated on an interface between the gate and the gate insulator. As a result, a trapping caused by the concentrated electric charges on the interface and defects at the amorphous silicon layer are prevented, so that characteristics of the first driving transistor QD1 may be maintained.

The second driving part 140 includes a second storage capacitor CST2 and a second driving transistor QD2. The second driving part 140 is connected to the anode of the light emitting diode EL to control the current flowing through the light emitting diode EL. In the present embodiment, a cathode of the light emitting diode EL has an electric potential lower than the bias voltage Vdd.

Particularly, the second storage capacitor CST2 has a first terminal connected to the source of the third switching transistor QS3 and the gate of the second driving transistor QD2 and a second terminal connected to the bias line VL. The second storage capacitor CST2 continuously applies a charged electron therein to the second driving transistor QD2 for one frame while the first data signal Vd1 is not applied due to turning-off of the third switching transistor QS3.

The second driving transistor QD2 controls the level of the bias voltage Vdd is applied to the drain thereof to supply the current to drive the light emitting diode EL in response to the first data signal Vd1 applied to the gate thereof. The value of the current applied to the light emitting diode EL from the second driving transistor QD2 depends upon the level of the first data signal Vd1 applied to the gate of the second driving transistor QD2, thereby adjusting the lighting level of the light emitting diode EL.

When the second data signal Vd2 is applied to the gate of the second driving transistor QD2, the second driving transistor QD2 is turned off, thereby dispersing electric charges concentrated on an interface between the gate and the gate insulator. As a result, the trapping caused by the concentrated electric charges on the interface and defects at the amorphous silicon layer are prevented, so that characteristics of the second driving transistor QD2 may be maintained.

As described above, the light emitting diode EL receives the current from the first and second driving transistors QD1 and QD2 electrically connected thereto and performs a light emitting and recovering operation.

In other words, the first driving transistor QD1 is positively biased during odd-numbered frames to supply the driving current to the light emitting diode EL, and the second driving transistor QD2 is negatively biased during the odd-numbered frames. Thus, the first driving transistor QD1 is deteriorated, but the second driving transistor QD2 is recovered.

On the contrary, the second driving transistor QD2 is positively biased during even-numbered frames to supply the driving current to the light emitting diode EL, and the first driving transistor QD1 is negatively biased during the odd-numbered frames. Thus, the second driving transistor QD2 is deteriorated, but the first driving transistor QD1 is recovered.

Figure 5A:
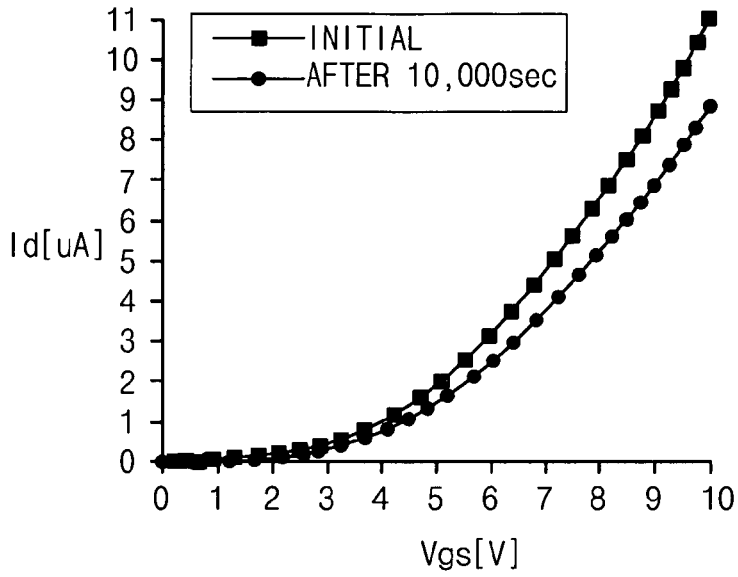
FIG. 5A is a graph illustrating a transmittance characteristic before and after a conventional transistor is biased.
Figure 5B:
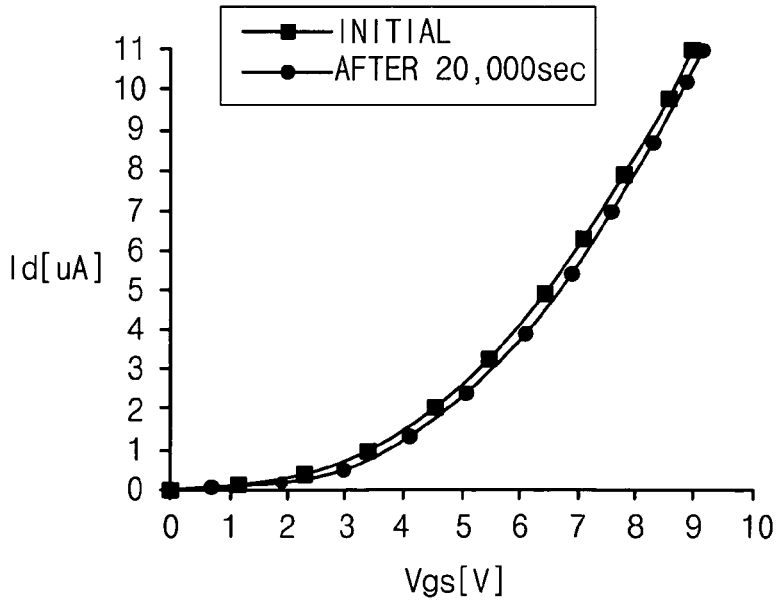
FIG. 5B is a graph illustrating a transmittance characteristic before and after a transistor is biased according to an exemplary embodiment of the present invention.

FIG. 5A is a graph illustrating a transmittance characteristic before and after a conventional transistor is biased. FIG. 5B is a graph illustrating a transmittance characteristic before and after a transistor is biased according to an exemplary embodiment of the present invention. Specifically, FIG. 5A is a graph showing the movement of a threshold voltage of a conventional amorphous silicon thin-film-transistor (TFT) driven for a long time, and FIG. 5B is a graph showing the movement of a threshold voltage of an amorphous silicon TFT according to an exemplary embodiment of the present invention.

As shown in FIG. 5A, when a conventional amorphous silicon TFT is driven for about 10,000 seconds, a transmittance characteristic curve moves significantly. In a condition for biasing the conventional amorphous silicon TFT, the conventional amorphous silicon TFT has a width to length ratio of about 200:3.5 micrometers, the bias voltage is applied for about 10,000 seconds, a gate-source voltage Vgs is about 13 volts, and a drain-source voltage Vds is about 13 volts.

In other words, when the gate-source voltage Vgs of the amorphous silicon TFT is about 8 volts at an initial drive, a drain current Id thereof is about 7 microamperes. However, when the gate-source voltage Vgs of the amorphous silicon TFT is about 8 volts after 10,000 seconds, the drain current Id thereof is about 5.5 microamperes.

The reduction of the drain current Id occurs due to an electric charge trapping in a silicon nitride used as the gate insulating layer and defects increasing in a channel of the amorphous silicon TFT. The characteristics of the amorphous silicon TFT may cause a deterioration of display quality of the light emitting device.

For example, when the driving current is continuously applied to the driving transistor while an image is displayed on a screen in the light emitting device, the characteristics of the amorphous silicon TFT may be deteriorated. Further, when the deteriorated amorphous silicon TFT is used for a long time, the driving current is reduced thereby deteriorating the display quality of the light emitting device.

As shown in FIG. 5B, although an amorphous silicon TFT according to an exemplary embodiment of the present invention is driven for about 20,000 seconds, a transmittance characteristic curve has only been slightly moved. In a condition for biasing the amorphous silicon TFT, the amorphous silicon TFT has a width to length ratio of about 200:3.5 micrometers, the bias voltage is applied for about 20,000 seconds, a gate-source voltage Vgs is about 13 volts, and a drain-source voltage Vds is about 13 volts.

In other words, when the gate-source voltage Vgs of the amorphous silicon TFT is about 8 volts at an initial drive, a drain current Id thereof is about 8 microamperes. However, when the gate-source voltage Vgs of the amorphous silicon TFT is about 8 volts even after 20,000 seconds, the drain current Id thereof is also about 8 microamperes.

Figure 6:
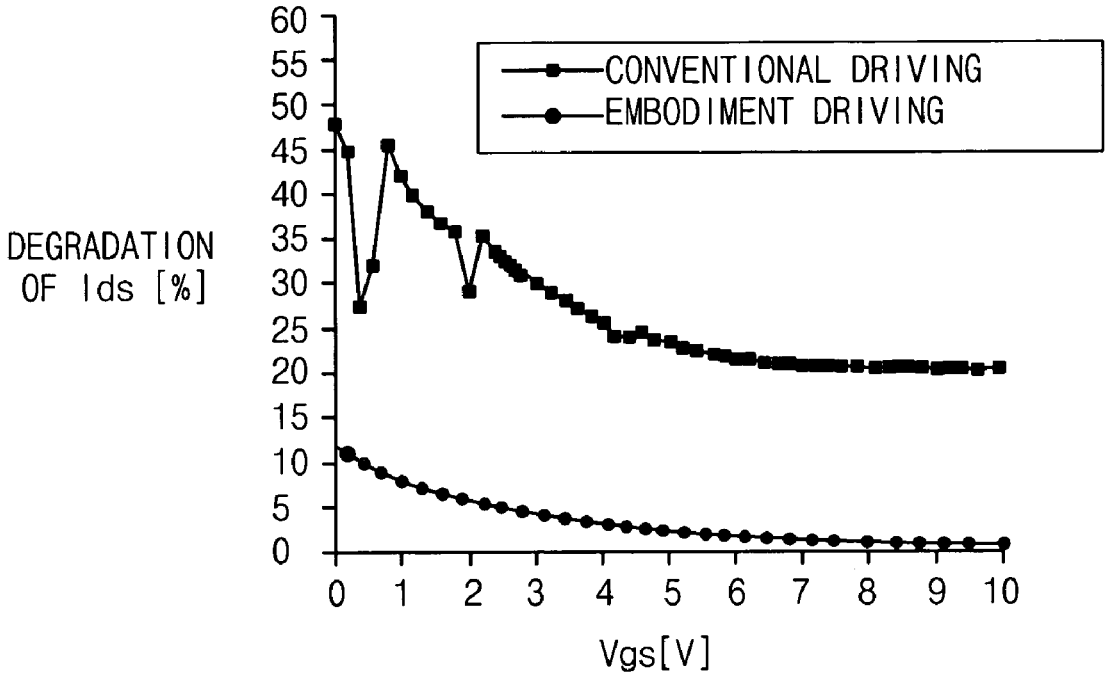
FIG. 6 is a graph showing a deterioration rate of a conventional amorphous silicon thin-film-transistor (TFT) and an amorphous silicon TFT according to an exemplary embodiment of the present invention.

FIG. 6 is a graph showing a deterioration rate of the conventional amorphous silicon TFT and the amorphous silicon TFT according to an exemplary embodiment of the present invention.

Referring to FIG. 6, when the gate-source voltage Vgs is from about 0 to about 2 volts, the deterioration rate of the drain-source current Ids of the conventional amorphous silicon TFT is from about 50 to about 35%. When the gate-source voltage Vgs gradually increases, the deterioration rate of the drain-source current Ids is closed to about 20%.

However, when the gate-source voltage Vgs of the amorphous silicon TFT of the present embodiment is from about 0 to about 2 volts, the deterioration rate of the drain-source current Ids of the amorphous silicon TFT of the present embodiment is from about 10 to about 5%. When the gate-source voltage Vgs gradually increases, the deterioration rate of the drain-source current Ids is closed to about 0%. In other words, the deterioration rate of the amorphous silicon TFT of the present embodiment is reduced as compared to the deterioration rate of the conventional amorphous silicon TFT.

FIGS. 7A to 7D are graphs illustrating a simulation result of a driving method of the light emitting device of FIG. 3 in accordance with an exemplary embodiment of the present invention. In FIGS. 7A to 7D, when a display panel has a resolution of 1024×768×3 pixels, a frame rate is about 16.7 milliseconds and a line period is about 20.7 microseconds.

Figure 7A:
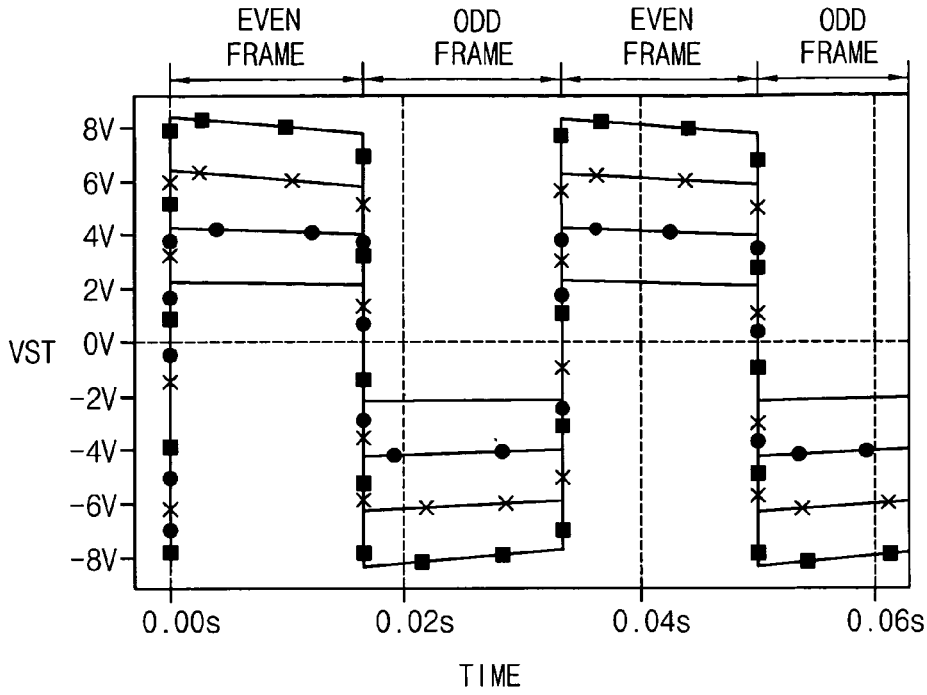
FIGS. 7A to 7D are graphs illustrating simulation results of a driving method according to an exemplary embodiment of the present invention.
Figure 7B:
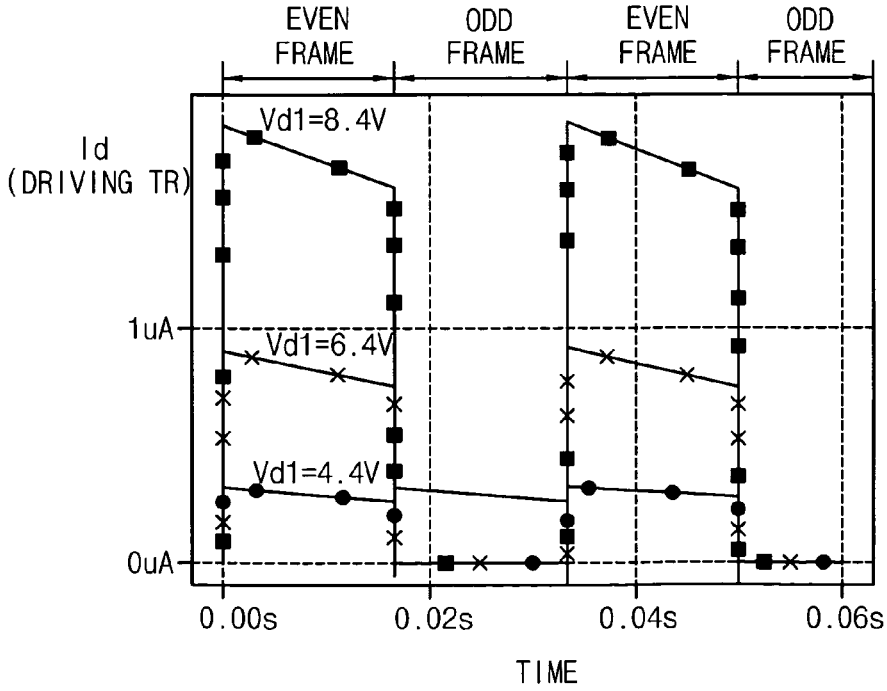

As shown in FIG. 7A, the first driving transistor QD1 charges the first storage capacitor CST1 with an electric charge while being driven during the odd-numbered frames, and the first driving transistor QD1 discharges the electric charge from the first storage capacitor CST1 while being driven during the even-numbered frames. Thus, the current Id flowing through the drain of the first driving transistor QD1 is as shown in FIG. 7B.

Figure 7C:
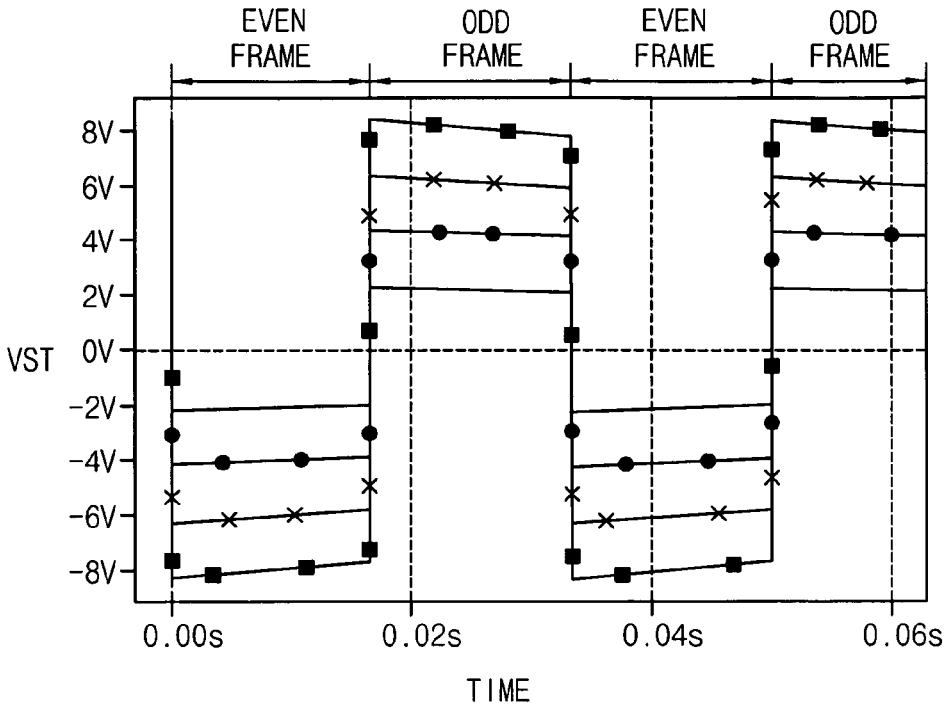
Figure 7D:
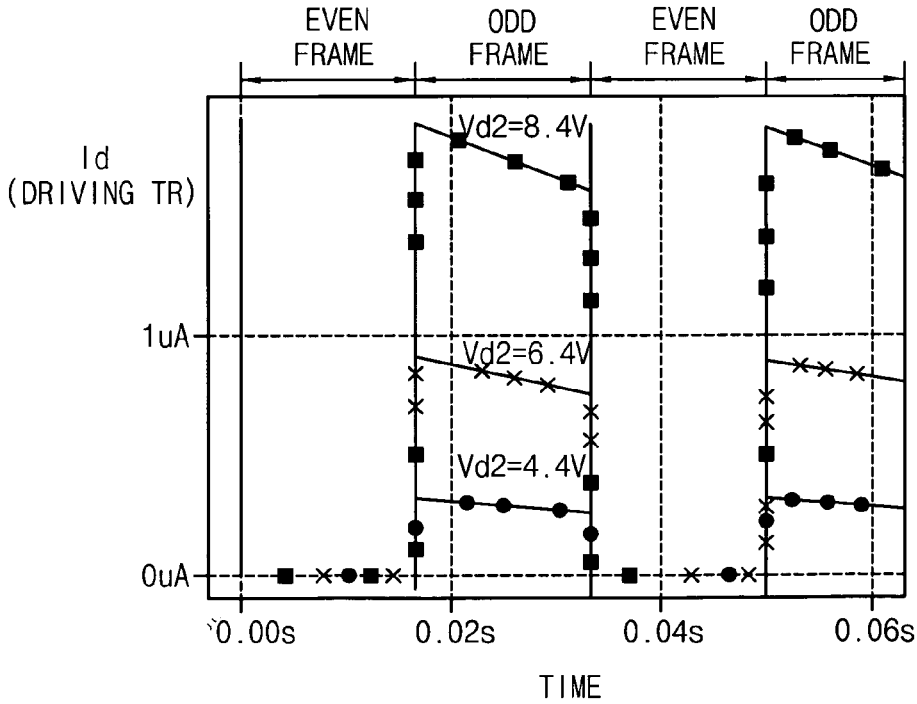

On the contrary, referring to FIG. 7C, the second driving transistor QD2 charges the second storage capacitor CST2 with an electric charge while being driven during the even-numbered frames, and the second driving transistor QD2 discharges the electric charge from the second storage capacitor CST2 while being driven during the odd-numbered frames. Thus, the current Id flowing through the drain of the second driving transistor QD2 is as shown in FIG. 7D.

Therefore, the first and second storage capacitors CST1 and CST2 may maintain the data signal at each frame of the odd-numbered and even-numbered frames.

Figure 8:
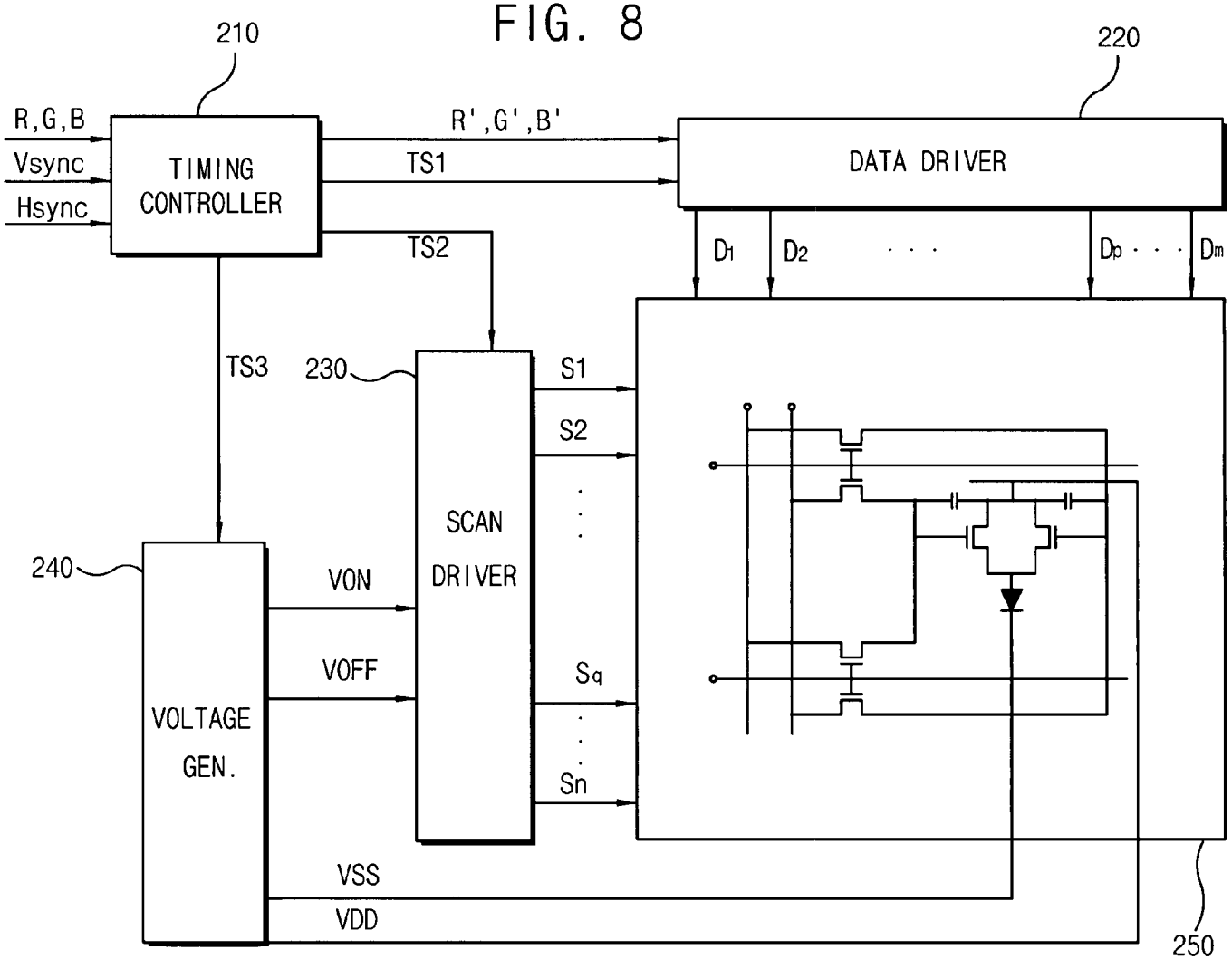
FIG. 8 is a block diagram showing a light emitting device according to an exemplary embodiment of the present invention.

FIG. 8 is a block diagram showing a light emitting device according to an exemplary embodiment of the present invention.

Referring to FIG. 8, a light emitting device includes a timing controller 210, a data driver 220 for outputting a data signal in response to an image signal, a scan driver 230 for outputting a scan signal in response to a timing signal, a voltage generator 240 for outputting a plurality of power voltages, and a light emitting display panel 250 for displaying an image through, for example, the light emitting diode EL of FIG. 3 in response to the data signal and the scan signal.

The timing controller 210 receives a first image signal (R, G, B) and control signals Vsync and Hsync from a graphics controller (not shown) to generate a first timing signal TS1 and a second timing signal TS2. The timing controller 210 applies the first timing control signal TS1 to the data driver 220 with a second image signal (R', G', B'). The timing controller 210 applies the second timing signal TS2 to the scan driver 130, and the timing controller 210 applies a third timing signal TS3 to the voltage generator 240 to control an output of the voltage generator 240.

In response to the second image signal (R', G', B') and the first timing signal TS1, the data driver 220 outputs first data signals D11, D21 . . . Dp1 . . . Dm1, which are in a first voltage direction and second data signals D12, D22 . . . Dp2 . . . Dm20, which are in a second voltage direction opposite the first voltage direction, to the light emitting display panel 250.

The first data signals D11, D21 . . . Dp1 . . . Dm1 have the first voltage direction, which corresponds to a gray-scale to display the image, and the second data signals D12, D22 . . . Dp2 . . . Dm2 have the second voltage direction to maintain the characteristics of, for example, the first and second driving transistors QD1 and QD2 of FIG. 3.

Thus, the first data signal Vd1 having the first voltage direction is applied to the gate of the first driving transistor QD1 through the first switching transistor QS1 for the odd-numbered frames, and the second data signal Vd2 having the second voltage direction is applied to the gate of the first driving transistor QD1 through the fourth switching transistor QS4 for the even-numbered frames.

On the other hand, the second data signal Vd2 in the second voltage direction is applied to the gate of the second driving transistor QD2 through the second switching transistor QS2 for the odd-numbered frames, and the first data signal Vd1 in the first voltage direction is applied to the gate of the second driving transistor QD2 through the third switching transistor QS3 for the even-numbered frames.

The scan driver 230 sequentially outputs the scan signals S1, S2 . . . Sq . . . Sn to the light emitting display panel 250 in response to the second timing signal TS2. Particularly, odd-numbered scan signals of the scan signals S1, S2 . . . Sq . . . Sn are sequentially applied to the light emitting display panel 250 for the odd-numbered frames, and even-numbered scan signals of the scan signals S1, S2 . . . Sq . . . Sn are sequentially applied to the light emitting display panel 250 for the even-numbered frames.

In response to the third timing signal TS3, the voltage generator 240 applies a gate on signal VON and a gate off signal VOFF to the scan driver 230 and provides the light emitting display device 250 with a common voltage VCOM and a bias voltage VDD.

The light emitting display panel 250 includes m units of a first data line DL1, m units of a second data line DL2, m units of a bias line VL, n units of a first scan line SL1, n units of a second scan line SL2, two scan lines SL adjacent to each other, and the light emitting diode EL formed in a region defined by the bias line VL and the first data line DL1. Also, the light emitting display panel 250 includes the amorphous silicon TFTs and the light emitting driving parts as shown in FIG. 3.

Particularly, the m units of first data line DL1 are extended in the vertical direction and arranged in the horizontal direction. The m units of first data line DL1 supply the first data signals D11, D21 . . . Dp1 . . . Dm1 to the light emitting driving parts.

The m units of second data line DL2 are extended in the vertical direction and arranged in the horizontal direction. The m units of second data line DL2 supply the second data signals D12, D22 . . . Dp2 . . . Dm2 to the light emitting driving parts.

The m units of bias line VL are also extended in the vertical direction and arranged in the horizontal direction. The m units of bias line VL supply the bias voltage VDD to the light emitting driving parts.

The n units of the scan line SL are extended in the horizontal direction and arranged in the vertical direction. The n units of the scan line SL supply the scan signals from the scan driver 230 to the light emitting driving parts.

Although not shown in FIG. 8, two transistors for use as the driving parts for the light emitting pixel may be formed on a same layer or different layer.

When the current flowing through the light emitting diode EL is controlled using the two transistors, the voltage applied to the transistors may be reduced. Also, a negative voltage such as the data signal in the second voltage direction may be alternately applied at every frame to recover the characteristics of the transistor or transistors, thereby enhancing the life span of the display device.

As describe above, because the negative voltage such as the data signal in the second voltage direction is applied to the gate of the amorphous silicon TFT for a predetermined time, the deterioration of the transistor may be prevented and the light emitting display device may have an enhanced life span.

Also, although the polysilicon TFT is applied to the light emitting display panel or a scan drive integrated circuit of the light emitting display panel, the deterioration of the transistor may be prevented, so that a manufacturing time and cost for the light emitting display device may be reduced.

Although the exemplary embodiments of the present invention have been described, it is understood that the present invention should not be limited to these exemplary embodiments but various changes and modifications can be made by one of ordinary skill in the art within the spirit and scope of the present invention as hereinafter claimed.

What is claimed is:

1. A driving device for controlling a current applied to a light emitting diode, comprising:

a first driving part connected to the light emitting diode, the first driving part including a first driving transistor;

a second driving part connected to the light emitting diode, the second driving part including a second driving transistor;

a first switching part including first and second switching transistors, the first switching transistor for being activated by a scan signal from a first scan line during a first frame to apply a first data voltage inputted from a first data line to the first driving transistor and the second switching transistor for being activated by the scan signal from the first scan line during the first frame to apply a second data voltage inputted from a second data line to the second driving transistor; and a second switching part including third and fourth switching transistors, the third switching transistor for being activated by a scan signal from a second scan line during a second frame to apply the first data voltage inputted from the first data line to the second driving transistor and the fourth switching transistor for being activated by the scan signal from the second scan line during the second frame to apply the second data voltage inputted from the second data line to the first driving transistor, wherein the first data voltage has a positive magnitude and the second data voltage has a negative magnitude during each of the first and second frames.

2. The driving device of claim 1, wherein during the first frame the first data voltage causes the first driving transistor to apply current to the light emitting diode and during the second frame the second data voltage turns off the first driving transistor.

3. The driving device of claim 2, wherein the first driving part further comprises:

a first storage capacitor having a first terminal connected to the first switching transistor and a second terminal connected to a bias line, the first driving transistor for controlling a level of a bias voltage to supply the current to the light emitting diode in response to the first data voltage applied from the first switching transistor through a control electrode of the first switching transistor during the first frame, and for being turned off in response to the second data voltage applied from the fourth switching transistor through a control electrode of the fourth switching transistor during the second frame.

4. The driving device of claim 3, wherein the first driving transistor is deteriorated by the first data voltage having the positive magnitude and annealed by the second data voltage having the negative magnitude.

5. The driving device of claim 1, wherein the first driving transistor is an amorphous silicon thin-film-transistor (TFT).

6. The driving device of claim 1, wherein during the first frame the second data voltage turns off the second driving transistor and during the second frame the first data voltage causes the second driving transistor to apply current to the light emitting diode.

7. The driving device of claim 6, wherein the second driving part further comprises:

a second storage capacitor having a first terminal connected to the second switching transistor and a second terminal connected to a bias line, the second driving transistor for being turned off in response to the second data voltage applied from the second switching transistor through a control electrode of the second switching transistor during the first frame, and for controlling a level of a bias voltage to supply the current to the light emitting diode in response to the first data voltage applied from the third switching transistor through a control electrode of the third switching transistor during the second frame.

8. The driving device of claim 7, wherein the second driving transistor is deteriorated by the first data voltage having the positive magnitude and annealed by the second data voltage having the negative magnitude.

9. The driving device of claim 1, wherein the second driving transistor is an amorphous silicon TFT.

10. The driving device of claim 1, wherein the first switching transistor has a first current electrode connected to the first data line for transmitting the first data voltage, a control electrode connected to the first scan line, and a second current electrode connected to the first driving transistor; and the second switching transistor has a first current electrode connected to the second data line for transmitting the second data voltage, a control electrode connected to the first scan line, and a second current electrode connected to the second driving transistor.

11. The driving device of claim 1, wherein the first and second switching transistors are amorphous silicon TFTs.

12. The driving device of claim 1, wherein the third switching transistor has a first current electrode connected to the first data line for transmitting the first data voltage, a control electrode connected to the second scan line, and a second current electrode connected to the second driving transistor; and the fourth switching transistor has a first current electrode connected to a the second data line for transmitting the second data voltage, a control electrode connected to the second scan line, and a second current electrode connected to the first driving transistor.

13. The driving device of claim 1, wherein the third and fourth switching transistors are amorphous silicon TFTs.

14. A method of driving a light emitting diode comprising:

receiving, at first and second switching transistors, a first scan signal from a first scan line during a first frame;

applying, from the first switching transistor, a first data voltage inputted from a first data line to a first driving transistor connected to a light emitting diode and applying, from the second switching transistor, a second data voltage inputted from a second data line to a second driving transistor connected to the light emitting diode, in response to the first scan signal;

receiving, at third and fourth switching transistors, a second scan signal from a second scan line during a second frame; and applying, from the fourth switching transistor, the second data voltage inputted from the second data line to the first driving transistor connected to the light emitting diode and applying, from the third switching transistor, the first data voltage inputted from the first data line to the second driving transistor connected to the light emitting diode, in response to the second scan signal, wherein the first data voltage has a positive magnitude and the second data voltage has a negative magnitude during each of the first and second frames, and wherein during the first frame the first data voltage causes the first driving transistor to apply current to the light emitting diode and the second data voltage turns off the second driving transistor and during the second frame the first data voltage causes the second driving transistor to apply current to the light emitting diode and the second data voltage turns off the first driving transistor.

15. The driving method of claim 14, further comprising:

sequentially charging the first data voltage and the second data voltage in response to the first scan signal.

16. The driving method of claim 14, further comprising:

sequentially charging the second data voltage and the first data voltage in response to the second scan signal.

17. The driving method of claim 14, wherein the first driving transistor is deteriorated while applying the bias voltage to the light emitting diode in response to the first data voltage, and annealed in response to the second data voltage to slow the deterioration of the first driving transistor, wherein the deterioration occurs during the first frame and the annealing occurs during the second frame.

18. The driving method of claim 14, wherein the second driving transistor is annealed in response to the second data voltage to slow a deterioration of the second driving transistor, and the second driving transistor is deteriorated while applying the bias voltage to the light emitting diode in response to the first data voltage, wherein the annealing occurs during the first frame and the deterioration occurs during the second frame.

19. A display panel comprising:

a first data line for transmitting a first data signal;

a second data line for transmitting a second data signal;

a bias tine for transmitting a bias voltage;

a first scan line for transmitting a first scan signal;

a second scan line for transmitting a second scan signal;

a first switching part including a first switching transistor connected to the first data line and the first scan line and a second switching transistor connected to the second data line and the first scan line;

a second switching part including a third switching transistor connected to the first data line and the second scan line and a fourth switching transistor connected to the second data line and the second scan line;

a light emitting diode formed in a region defined by the first and second data tines and the first and second scan lines; and a driver comprising a first driving transistor connected to the tight emitting diode and the first and fourth switching transistors and a second driving transistor connected to the light emitting diode and the second and third switching transistors, wherein when the first scan line is activated the first switching transistor applies the first data voltage to the first driving transistor and the second switching transistor applies the second data voltage to the second driving transistor, and when the second scan line is activated the third switching transistor applies the first data voltage to the second driving transistor and the fourth switching transistor applies the second data voltage to the first driving transistor, and wherein the first data voltage has a positive magnitude and the second data voltage has a negative magnitude when each of the first and second scan signals are activated.

20. The display panel of claim 19, wherein when the first scan signal is activated the second data voltage turns off the second driving transistor and when the second scan signal is activated the first data voltage causes the second driving transistor to apply current to the light emitting diode.

21. The display panel of claim 19, wherein when the first scan signal is activated the first data voltage causes the first driving transistor to apply current to the light emitting diode and when the second scan signal is activated the second data voltage turns off the first driving transistor.

22. A display device comprising:

a timing controller for outputting an image signal and a timing signal;

a data driver for outputting a first data signal having a positive magnitude to a first data line and a second data signal having a negative magnitude to a second data line in response to the image signal;

a scan driver for alternately outputting a first scan signal to a first scan line and a second scan signal to a second scan line during two frames in response to the timing signal; and a light emitting display panel comprising:

a first switching part including a first switching transistor connected to the first data line and the first scan line and a second switching transistor connected to the second data line and the first scan line;

a second switching part including a third switching transistor connected to the first data line and the second scan line and a fourth switching transistor connected to the second data line and the second scan line;

a light emitting diode;

a first driving transistor connected to the light emitting diode and the first and fourth switching transistors; and a second driving transistor connected to the light emitting diode and the second and third switching transistors, wherein, when the first scan signal is applied to the light emitting display panel, the first switching transistor applies the first data voltage to the first driving transistor and the second switching transistor applies the second data voltage to the second driving transistor such that the light emitting display panel displays an image in response to the first data signal applied to the first driving transistor, and prevents deterioration of the second driving transistor in response to the second data signal applied to the second driving transistor, and wherein, when the second scan signal is applied to the light emitting display panel, the third switching transistor applies the first data voltage to the second driving transistor and the fourth switching transistor applies the second data voltage to the first driving transistor such that the light emitting display panel displays the image in response to the first data signal applied to the second driving transistor, and prevents deterioration of the first transistor in response to the second data signal applied to the first driving transistor.

23. The driving device of claim 1, wherein the second data voltage having the negative magnitude during the second frame and the first data voltage having the positive magnitude during the first frame have exactly opposite levels.

* * * * *

UNITED STATES PATENT AND TRADEMARK OFFICE

CERTIFICATE OF CORRECTION

PATENT NO. : 7,616,178 B2
APPLICATION NO. : 11/129603
DATED : November 10, 2009
INVENTOR(S) : You et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1049 days.

Signed and Sealed this

Nineteenth Day of October, 2010

David J. Kappos

David J. Kappos
*Director of the United States Patent and Trademark Office*